US005697807A

United States Patent [19]

Willey et al.

[11] Patent Number: 5,697,807

[45] Date of Patent: Dec. 16, 1997

[54] ELECTRICAL CONNECTOR

[75] Inventors: Christopher A. Willey, Johannesburg; Donald Charles Richardson, Balito, both of South Africa

[73] Assignee: Altech Industries (Proprietary) Limited, Boksburg East, South Africa

[21] Appl. No.: 575,000

[22] Filed: Dec. 19, 1995

[51] Int. Cl.[6] ..... H01R 9/07

[52] U.S. Cl. ..... 439/493; 439/67

[58] Field of Search ..... 439/67, 493, 632, 439/273, 276, 494, 495, 496, 936, 77

[56] References Cited

U.S. PATENT DOCUMENTS

| | | | |
|---|---|---|---|
| 3,082,398 | 3/1963 | Valach | 339/176 |
| 3,670,290 | 6/1972 | Angele et al. | 339/75 MP |
| 3,755,615 | 8/1973 | Paullus et al. | 439/936 |
| 3,916,516 | 11/1975 | Harms et al. | 29/628 |
| 4,023,877 | 5/1977 | Hennessey et al. | 339/17 F |
| 4,188,086 | 2/1980 | Inouye et al. | 339/176 MF |
| 4,191,441 | 3/1980 | Ryder et al. | 339/17 F |
| 4,213,665 | 7/1980 | Murray et al. | 439/77 |
| 4,639,057 | 1/1987 | Daum | 339/17 F |
| 4,639,062 | 1/1987 | Taniguchi et al. | 339/59 M |
| 4,647,136 | 3/1987 | Kinoshita et al. | 339/125 R |
| 4,695,108 | 9/1987 | Ichitsubo | 439/59 |
| 4,738,625 | 4/1988 | Burton et al. | 439/59 |
| 4,798,541 | 1/1989 | Porter | 439/67 |
| 4,959,030 | 9/1990 | Tatebe et al. | 439/67 |
| 5,002,494 | 3/1991 | Olsson | 439/77 |
| 5,104,324 | 4/1992 | Grabbe et al. | 439/62 |
| 5,110,305 | 5/1992 | Edgley et al. | 439/441 |
| 5,186,632 | 2/1993 | Horton et al. | 439/67 |

FOREIGN PATENT DOCUMENTS

| | | |
|---|---|---|
| 2 170 961 | 8/1986 | United Kingdom . |

*Primary Examiner*—Gary F. Paumen
*Assistant Examiner*—Tho D. Ta
*Attorney, Agent, or Firm*—Jacobson, Price, Holman & Stern, PLLC

[57] ABSTRACT

An electrical connector has a base with a row of conductor openings through the base and a slotted plug socket in one base side parallel to the row. A plug has conductive surfaces and is insertable into the socket to wedge conductors against the conductive surfaces. Conductor grooves are provided in the socket at positions matching the conductive surfaces.

8 Claims, 2 Drawing Sheets

ELECTRICAL CONNECTOR

FIELD OF THE INVENTION

This invention relates to an electrical connector, and more particularly an electrical connector which allows a sealed connection to be achieved.

BACKGROUND TO THE INVENTION

There are many different sealed systems for connecting electrical conductors together. In the application of electrical detonators, the connection of the conductors to the detonator is required to be sealed against water and moisture. In this regard, not only must the insulation around a conductor be sealed to the detonator housing, but the conductor itself must be sealed. If the insulation only is sealed, any leakage in the covering will allow moisture to enter underneath the insulator around the wire.

OBJECT OF THE INVENTION

It is an object of this invention to provide an electrical connector which can, inter alia, alleviate the above-mentioned difficulty.

SUMMARY OF THE INVENTION

In accordance with this invention there is provided an electrical connector comprising a base having first and second sides, with conductor openings through the base leading from the first to the second side, there being socket means in the second side spaced from the openings, and, a plug having conductive surfaces and being insertable into the socket to wedge a conductor therein in use against the conductive surfaces.

Preferably the openings are located in a row parallel with and spaced apart from a socket extending as a slit in the surface of the socket side.

There is also provided for the openings in the entrance side to have a wide throat tapering to the normal opening diameter, and for there to be grooves in the socket side, extending from the openings across the socket side surface, and into the socket, and to extend on opposite sides of the socket in the depth of the groove. It is provided for there to be a set of grooves in the socket for each of the openings.

Preferably the groove on one side of the socket is deep enough to fully receive the thickness of a predetermined size conductor, and the groove on the opposite side for the same socket is shallower, and sized to allow the predetermined size conductor to protrude above the surface surrounding the groove in use.

BRIEF DESCRIPTION OF THE DRAWING

A preferred embodiment of the invention is described below by way of example only, and with reference to the accompanying drawings, in which.

DETAILED DESCRIPTION OF THE DRAWINGS WITH REFERENCE TO THE DRAWINGS

Figure 1:
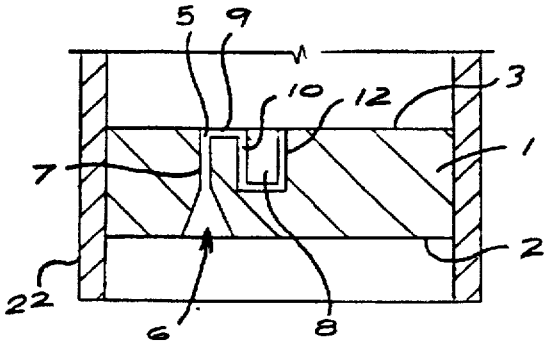
FIG. 1 is a diametrical cross-sectional view of a portion of a detonator housing fitted with a base according to the invention.
Figure 3:
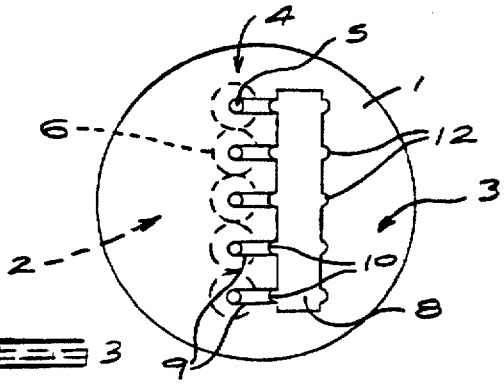
FIG. 3 is a top view of the base of the embodiment of FIG. 1.

Referring to FIGS. 1 and 3, a base (1) is provided as part of an electrical connector, and is disc-shaped having opposing major circular surfaces.

One surface forms an entrance side (2) for cable conductors, and the other surface forms an opposing socket side (3).

Located in a row (4) are openings (5) extending axially through the base (1) from entrance side (2) to socket side (3). The openings on the entrance side (2) have a wide tapered throat (6) which narrows down to the normal opening diameter as indicated by numeral (7).

A socket (8) is rectangular in shape is formed in base and located spaced apart but parallel to the row (4) of openings (5). The socket (8) extends approximately halfway into the base (1) in its depth. Each of the openings (5) has a groove (9) extending in the surface of entrance side (3) from the opening (5) to the socket (8). The groove (9) is sized to receive a predetermined thickness of electrical conductor wire (20). The groove (9), on meeting the socket (8), extends downwardly at (10) into the socket depth axially in the orientation of the base, to the bottom. Located immediately opposite on the other side of the socket (8) are matching groove sections (12). The groove (10) closest to the openings (8) has a depth which is greater than the thickness of the intended conductor (20), and the groove (12) has a depth which is approximately half the thickness of the intended conductor (20).

Figure 2:
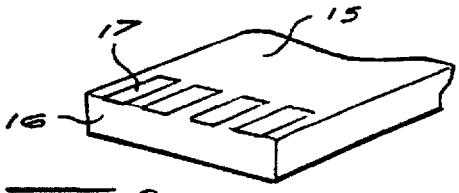
FIG. 2 is an isometric view of a plug according to the invention.

Referring to FIG. 2, a plug (15) for use with the base (1) is a slab of generally rectangular configuration, and having a cross-sectional dimension enabling it to be plugged at one end (16) into the socket (8). On at least one of the major plug surfaces towards the end of (16), are located conductive strips (17) spaced apart from each other to align with the spacing of the grooves (12) in the socket (8). The conductive strips (17) may be connected to whatever circuitry is required (not shown).

Figure 4:
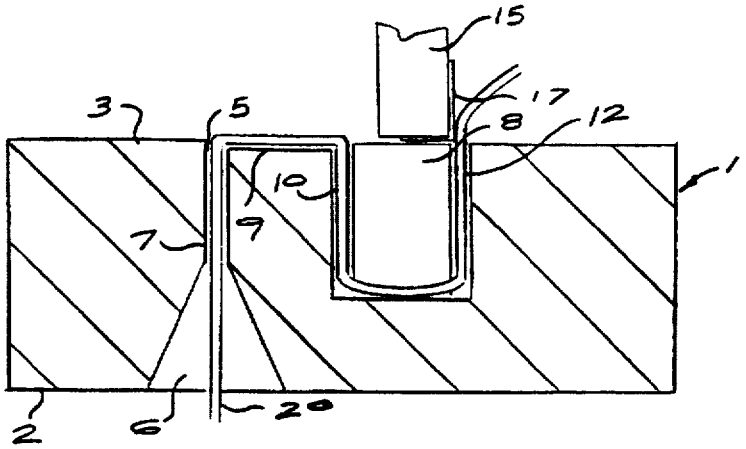
FIG. 4 is an enlarged cross-sectional view of the base of FIG. 1 showing a conductor being located therein with a plug in position for insertion.

Referring to FIG. 4, the base (1) of FIG. 1 together with a plug (15) as described with reference to FIG. 2, is shown in enlarged cross-section. Like numerals used in the description of the reference to the previous sketches, indicate like elements.

In use, a conductor (20) being one conductor of a cable, and preferably a ribbon cable in this instance, is bared of its insulation and pushed through the openings (5) from the cable entrance side (2). The wide throat (6) assists in guiding a row of such bared conductors (20) into the openings (5). The ends protrude from the surface of socket side (3), and are bent over towards the socket (8) to be located in the grooves (9) extending between the openings (5) and the socket.

The wires are then formed by a forming tool similar to the plug (15), into the grooves (10, 12) within the socket (8). By pushing the forming tool into the socket (8), the conductor (20) is bent into the grooves (10) and (12) which correspond to the particular opening (5) for that conductor. The formed conductor is completely seated in the groove (10), but will project in its thickness from the groove (12) on the opposite side and furtherest from the opening (5). The plug (15) then may be inserted into the socket, with the conductive strip (17) facing the grooves (12). The strips (17) contact conductors (20) in the grooves. Thus contact is made between the conductive strips (17) and the conductors (20). The grooves (10) allows the plug (15) to slide into the socket (8) without engaging the conductors (20) on the side of the socket (8) adjacent openings (5) and possibly shearing.

Alternatively, both sides of the plug may have strips, and provision may be made for the wires to project to contact both sides of the plug.

The space between the surface (2) of the base and the surrounding housing (22) of a detonator (FIG. 1) is then filled with an epoxy or other suitable sealant mixture, and the conductor wire itself as well as the insulation is then sealed to the detonator.

The electrical connection from the conductor (20) to the relevant circuitry within the detonator is achieved from the plug (15) in the base (1). This enables the final cable connection to be made with a reliable seal.

Figure 5:
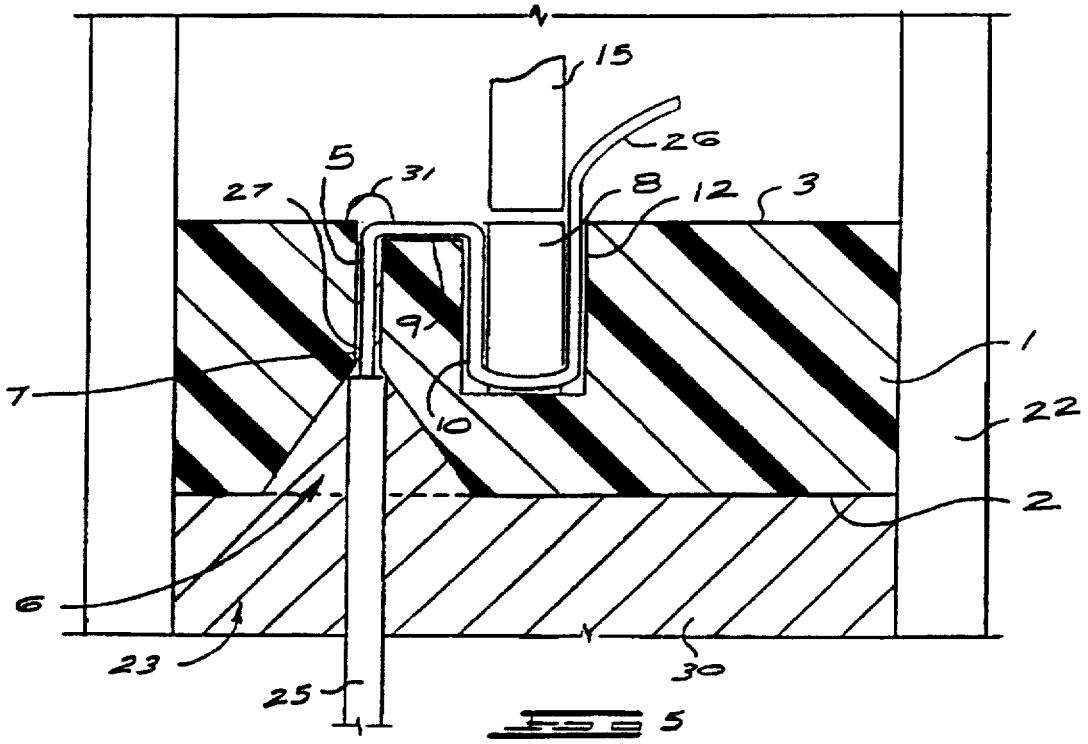
FIG. 5 is an alternative embodiment of similar view to that of FIG. 4.

Referring to FIG. 5, the disc-shaped base (1) as described with reference to FIGS. 1 to 4 is located within the end of a tubular detonator housing (22), as described with reference to FIG. 1. Like numerals in FIG. 5 indicate like numerals as described with references to FIGS. 1 to 4. In this embodiment however, the conductor (25) has its insulation extending around the wire strand (26) of the conductor, all the way to apex (27) of the funnel shaped entrance (6) to the opening (5) for the conductor.

It has been found in practice that it can be convenient sometimes to be able to insert the wire strand (26) of conductor (25) through the normal opening diameter (7), of opening (5) so that the insulation end abuts the apex of the funnel (6), since there is then no requirement for spacing the end of the insulation away from the base (1).

However it is then more difficult to seal the incoming wire for the connector. Whilst any sealant located in the space (23) may seal around the insulation, it will not necessarily seal around the wire strand (26). Any opening caused by a break in the insulation (25), allows moisture to be drawn up between the insulation and the conductor by capillary action and into the interior of the detonator.

In this embodiment, a sealant (30) is used which has a viscosity which enables the sealant to flow around the end of the insulation at the apex of the funnel, and into and through the normal diameter opening (7). The viscosity is empirically chosen to enable this flow. The sealant drawn through the opening (5) by capillary action forms a bead (31) at the socket (3) side of base (1), where it sets as the sealant hardens with time.

What I claim and desire to secure by Letters Patent is:

1. An electrical connector comprising a base having first and second sides with conductor openings through the base leading from the first side to the second side, there being a socket in the second side spaced from the openings and generally parallel to the openings, and, a plug having conductive surfaces and being insertable into the socket to wedge conductors therein in use against the conductive surfaces, the openings being located in a row parallel with and spaced apart from said socket, said socket extending as a slit in the second side, the openings in the first side having a wide throat tapering to a normal diameter portion of said openings, and further comprising grooves in the second side, extending from the openings across the second side, said grooves extending into the socket, and extending on opposite sides of the socket to the depth of the socket.

2. An electrical connector as claimed in claim 1 in which there are two grooves running axially on opposite sides of said socket and opposite to each opening.

3. An electrical connector as claimed in claim 1 in which the groove on one side of the socket is deep enough to fully receive a thickness of a predetermined size conductor, and the groove on the opposite side of the socket is shallower, and sized to allow the predetermined conductor to protrude above surfaces of said socket surrounding the groove for contacting said conductive surfaces on the plug.

4. An electrical connector as claimed in claim 1 in which the conductors are sealed in position by a sealant located over the first side and within the tapering throats.

5. An electrical connector as claimed in claim 4 in which the sealant is an epoxy sealant.

6. An electrical connector as claimed in claim 4 in which the conductors have insulation extending into the throats of the openings, and are sealed in this position by a sealant which has been drawn into the normal diameter portions of said openings by capillary action.

7. An electrical connector comprising a base of nonconductive material, said base including a conductor entrance surface and a plug receiving surface, said surfaces being spaced from each other, said base including a conductor opening extending between said surfaces of the base, a conductor extending through said opening from the conductor entrance surface to the plug receiving surface, said plug receiving surface including an inwardly extending socket oriented in spaced, substantially parallel relation to the opening, said socket including parallel, spaced side walls oriented in opposed relation, said plug receiving surface including a groove extending between the end of the opening at the plug receiving surface to an end of an adjacent side wall of said socket, said socket side walls including a groove, all of said grooves being in alignment, said conductor being positioned in said grooves, a plug telescopically inserted into said socket and closely associated with the side walls to anchor the conductor in the grooves and socket, said plug including a conductive element mounted thereon for electrical contact with the conductor in the socket.

8. The electrical connector as defined in claim 7 wherein the groove in the side wall of the socket adjacent the opening is dimensioned to completely receive the conductor therein, said groove in the side wall of the socket remote from the opening being dimensioned to only partially receive the conductor, said conductive element on the plug being aligned with and conductively engaging the conductor in the side wall of the socket remote from the opening.

* * * * *